US006067955A

United States Patent [19]

Boecking

[11] Patent Number: 6,067,955

[45] Date of Patent: May 30, 2000

[54] FUEL INJECTION DEVICE FOR INTERNAL COMBUSTION ENGINES

[75] Inventor: Friedrich Boecking, Stuttgart, Germany

[73] Assignee: Robert Bosch GmbH, Stuttgart, Germany

[21] Appl. No.: 09/308,716

[22] PCT Filed: Apr. 3, 1998

[86] PCT No.: PCT/DE98/00945

§ 371 Date: Jun. 30, 1999

§ 102(e) Date: Jun. 30, 1999

[87] PCT Pub. No.: WO99/15783

PCT Pub. Date: Apr. 1, 1999

[30] Foreign Application Priority Data

Sep. 24, 1997 [DE] Germany ..... 197 42 073

[51] Int. Cl.[7] ..... F02B 3/00

[52] U.S. Cl. ..... 123/299; 123/501

[58] Field of Search ..... 123/299, 300, 123/467, 498, 501

[56] References Cited

U.S. PATENT DOCUMENTS

| | | | |
|---|---|---|---|
| 3,391,680 | 7/1968 | Benson | 123/299 |
| 4,331,434 | 5/1982 | Brunais | 123/299 |
| 4,546,739 | 10/1985 | Nakajima | 123/299 |
| 5,647,316 | 7/1997 | Hellen | 123/299 |
| 5,979,410 | 11/1999 | Grieshaber | 123/300 |

*Primary Examiner*—Carl S. Miller

*Attorney, Agent, or Firm*—Ronald E. Greigg; Edwin E. Greigg

[57] ABSTRACT

A fuel injection device for internal combustion engines is proposed in which a fuel injection valve is controlled by the pressure in a pressure chamber, which acts on a pressure shoulder in its opening and closing direction. The pressure supply to the a pressure chamber is controlled by a control valve member which in turn is moved by a pressure in a working chamber. The pressure in the working chamber is controlled by a pre-control valve which has a closing body which, through the influence of the piezoelectric drive mechanism, is moved from a second valve seat to a first valve seat and thereby momentarily opens a relief line of the working chamber. This movement results in an opening of the control valve member and a supplying of high fuel pressure to the pressure chamber for purposes of injection. Thus a very small pre-injection quantity is produced. In order to produce a main injection quantity, the closing body is positioned in an intermediate position between the valve seats and a longer connection of the high-pressure fuel supply to the pressure chamber is consequently produced.

6 Claims, 2 Drawing Sheets

FUEL INJECTION DEVICE FOR INTERNAL COMBUSTION ENGINES

BACKGROUND OF THE INVENTION

The invention is directed to improvements on a fuel injection device for internal combustion. In a fuel injection device of this kind, which is known from EP 0 657 642, the high-pressure fuel source is comprised of a high-pressure fuel pump, which delivers fuel from a low-pressure chamber into a high-pressure accumulation chamber, which is connected by way of pressure lines to individual injection valves that protrude into the combustion chamber of the engine to be supplied, wherein the common pressure storage system (common rail) is kept at a particular pressure level by means of a pressure control device. In order to control injection times and injection quantities, an electrically controlled control valve is provided to each of the injection valves and controls the high-pressure fuel injection with its opening and closing. The control valve in the known fuel injection device is embodied as a 3/2-way valve that connects a pressure conduit, which feeds at the injection opening of the respective injection valve, to the injection line leading from the high-pressure source or to a relief line into a low-pressure chamber.

Since the 3/2-way control valve in the known fuel injection device is actuated directly by the actuator of an electromagnet, the known fuel injection device has the disadvantage that the stroke of the valve member of the 3/2-way control valve and therefore the control effectiveness of the valve is limited. With the known fuel injection device, due to the use of an electromagnet, it is particularly difficult to achieve a high switching speed, especially if the intent is to use this device for the injection of a small pre-injection quantity and then a large main injection quantity via the fuel injection valve, therefore the control valve must consequently be opened and closed twice for this procedure.

OBJECTS AND SUMMARY OF THE INVENTION

It is a principal object of fuel injection device according to the invention that with the aid of the control valve, a greater through flow cross section can be produced, which permits a rapid opening and closing of the injection valve member, and a small electrically controlled pre-control valve is used to switch the control valve that makes the large through flow cross sections available. Since a piezoelectric drive mechanism is additionally used to actuate the valve member of the pre-control valve, an increased switching speed can be achieved.

Another object of the invention is to provide an increase in the switching speed for the production of a pre-injection is additionally achieved by means of the measure that the pre-control valve has two valve seats that are disposed in the course of the relief conduit of the working chamber and are alternatingly opened and closed with a single actuation of the pre-control valve member. As a result, without time loss due to the building up or attenuation of a field in an electromagnet and without the high energy requirement that would otherwise be required for this, an intermediary relief of the working chamber is achieved with a single excitation of the piezoelectric drive mechanism, which is only determined by the path that the precontrol valve member has to travel and by the actuation speed of the piezoelectric drive mechanism. Still another object of the invention provides that in connection with the very large cross section that can be controlled by the control valve, a very rapid switching of the control valve can thus be achieved and correspondingly small injection quantities can be controlled. Yet another object of the invention is that in order to be able to assume a different position that lies between the valve seats, by means of the property of the piezoelectric drive mechanism with its actuation mechanism, the main injection quantity can also be controlled in a highly precise manner.

BRIEF DESCRIPTION OF THE DRAWINGS

An exemplary embodiment of the injection is depicted in the drawings and will be explained in more detail in the description that follows.

DESCRIPTION OF THE EXEMPLARY EMBODIMENT

Figure 1:
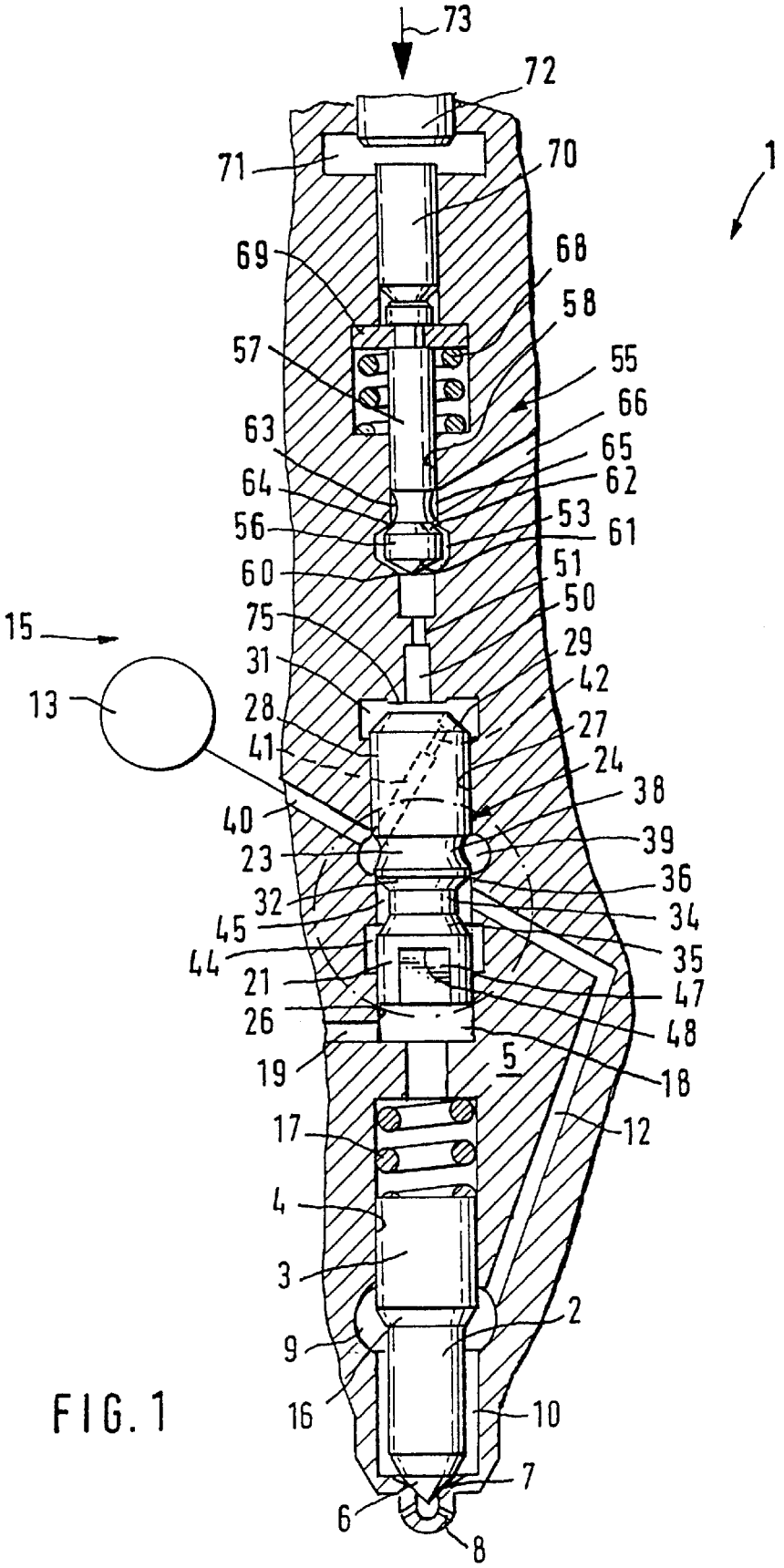
FIG. 1 shows a complete depiction of the invention.

The fuel injection valve 1 depicted in FIG. 1 has a fuel injection valve member 2, which is guided with a guide part 3 in a bore 4 of a fuel injection valve housing 5. At one end of the fuel injection valve member, it has a sealing face 6, which can be brought into contact with a valve seat 7 on the housing and thereby separates fuel injection openings 8 from a pressure chamber 9, which extends to the valve seat 7 in the form of an annular chamber 10 around the end of the fuel injection valve member 2. The pressure chamber 9 can be connected to a high-pressure fuel source 13 via a pressure conduit 12 and a control valve 15. Fuel that has been brought to injection pressure is always available in the high-pressure fuel source.

In the region of the pressure chamber 9, the injection valve member has a pressure shoulder 16 by means of which it can be opened away from the valve seat 7 for the purpose of injection with the pressurization of the pressure chamber 9, counter to a closing spring 17 that acts on the rear end of the fuel injection valve member 2. The rear chamber 18 that contains the closing spring 17 is pressure relieved by means of a relief conduit 19.

The chamber 18 is defined on the one end by an end piston 21 of a control valve member 23 that is disposed coaxial to the fuel injection valve member. This is part of a control valve 24, that is embodied as a 3/2-way valve. In this connection, the control valve member 23 is guided in a stepped bore, whose smaller diameter part 26 also contains the chamber 18 and guides the end piston 21 in a sealed fashion and whose larger diameter part 27 guides a piston part 28 of the control valve member 23. With its end face 29, the piston part 28 defines a working chamber 31 in the fuel injection valve housing and on its end remote from the end face 29, is provided with a conically extending first sealing face 32, which tapers down to a diameter region 34. Forming a control edge 46, the diameter reduction region 34, which 34 then widens conically, transitioning into the end of the end piston 21 remote from the pressure chamber 18. The first sealing face 32 cooperates with a first valve seat 36 embodied at the transition of the larger diameter stepped bore part 27 into the smaller diameter stepped bore part 26. A movement of the control valve member 23 in the other direction is limited by the contact of its end face 29 against a wall 75 that defines the working chamber 31 on the other end.

In the region between the end face 29 and the first sealing face 32, the piston part 28 has an annular restriction 38 and defines an annular chamber 39 there, which, together with an internal recess of the larger diameter stepped bore part 27, is embodied adjacent to the first valve seat 36 and continuously communicates with the high-pressure fuel source 13 by way of a pressure line 40. In the piston part 28, a conduit 41 is provided, which extends obliquely in relation to the longitudinal axis of the control valve member 23; this conduit 41 connects the restriction 38 to the working chamber 31 and, toward the end of the working chamber 31, has a diameter limitation 42 that throttles the inflow of pressure fluid, which fluid is constituted by fuel from the high-pressure fuel source, into the working chamber 31 or limits its inflow rate.

Figure 2:
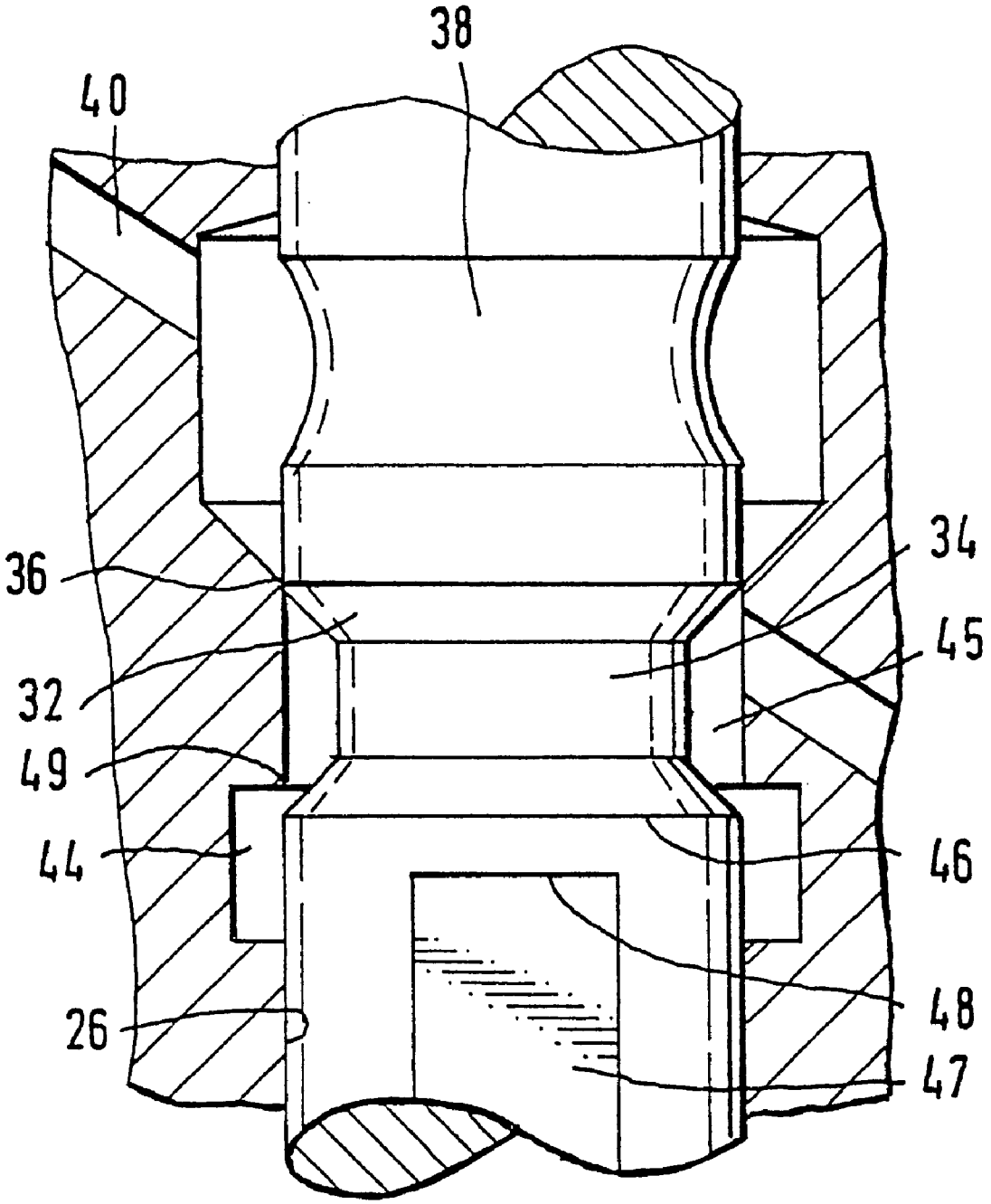
FIG. 2 shows a detailed enlargement of the depiction from FIG. 1.

In the smaller diameter stepped bore part 26, between the wall of the stepped bore and the diameter reduction 34 an annular chamber 45 is embodied on the control valve member 23 and the pressure conduit 12 feeds into this annular chamber. In the wall of the stepped bore part 26, an internal recess 44 is also provided, with a defining edge 49 oriented toward the valve seat 36, which edge, together with the control edge 46 of the end piston 21, constitutes a sliding valve. Furthermore, a flattend region 47 is provided on the end piston which, together with the wall of the smaller diameter stepped bore part 26, forms a through flow cross section that is always open in relation to the chamber 18. Toward the end of the annular chamber 45, the flattend region 47 is defined by a horizontal edge 48, which is disposed so that in the position of the control valve member 23 shown in FIG. 2, when the first sealing face 32 is resting against the first valve seat 36, a connection is produced from the chamber 18 to the internal recess 44 via the flattend region 47 and therefore to the pressure chamber via the pressure conduit 12. In this position of the valve member 23, the pressure chamber 9 is relieved. This connection is only closed when the first sealing face 32 has been opened from the first valve seat with an axial movement of the control valve member 23, wherein this stroke is limited by the contact of the end face 29 against the end wall 75. In the course of this movement, the control edge 46 travels past the defining edge 49 and, functioning as a sliding valve, closes the connection between the internal recess 44 and the annular chamber 45. Until reaching this position, the edge 48 of the flattend region always remains beneath the control edge 46 so that there is no connection between the chamber 18 and the annular chamber 45 and in this position, the fuel conveyed from the high-pressure fuel source to the pressure chamber 9 is not discharged to the chamber 18.

The working chamber 31 can be relieved via a relief line 50, which leads axially from the working chamber 31 and has a diameter or throttle 51 that defines an outflow rate. The relief conduit feeds into a valve chamber 53 of a pre-control valve 55. A closing body 56 of a valve member 54 of the precontrol valve 55 can be moved in the valve chamber 53 and this closing body 56 is disposed on the end of a tappet 57, which is guided in a guide bore 58 in the fuel injection valve housing 5. A first valve seat 60 of the pre-control valve is disposed at the entry of the relief conduit 50 into the valve chamber 53 and a first sealing face 61 on the closing body 56 comes into contact with this first valve seat in a first movement position of the closing body 56 and closes the outflow through the relief conduit 50. On the end of the closing body 56 opposite from the first sealing face 61, the closing body has a second sealing face 62, which transitions into an annular groove 63 of the tappet 57 toward the end of this tappet. In the guide bore 58, which feeds into the valve chamber 53 via a second valve seat 64, this annular groove adjoins an annular chamber 65, which continuously communicates with an exit conduit 66 of the relief conduit 50. In a second position of the closing body 56, with its second sealing face 62 in contact with the second valve seat 64, the closing body has closed off the connection of the relief line 50 from the valve chamber 53 to the continuing part 66 of the relief line.

Through the action of a restoring force in the form of a compression spring 68, the closing body 56 is acted on in the closing direction with contact of its second sealing face 62 against the second valve seat 64. To this end, the compression spring 68 is clamped between the housing of the fuel injection valve and a spring plate 69 on the tappet 57. The tappet 67 is acted on by another piston 70, which, with its other end, 20 defines a hydraulic chamber 71, which is defined on the other end by an actuation piston 72, which is part of a piezoelectric drive mechanism 73 that is not shown in detail here. Care is taken that the hydraulic chamber 61 is always filled. It is used for adjustment path translation in such a way that the actuating face of the actuation piston 72 is greater in cross section than the actuating face of the other piston 70 so that a small adjustment path of the actuation piston 72 produces a large adjustment path of the other piston 70 and a large opening stroke of the closing body 56 can correspondingly be produced. In particular, it is assured that the closing body 56 can move from the second valve seat 64 to the first valve seat 60 and a sealed closure of the relief line is achieved in both positions. The piezoelectric drive mechanism additionally makes it possible for the closing body 56 also to be able to remain in a middle position in which the through flow remains open at both valve seats 60 and 64 and a long-lasting relief of the working chamber 31 via the relief line 50 can consequently be set.

The fuel injection valve described above functions in the following manner: In the position of the closing body 56 shown, the relief line 50 is closed. In this instance, fuel that has been brought to injection pressure can travel from the high-pressure fuel reservoir 13 by way of the annular chamber 39, the conduit 41, and the throttle 42 into the working chamber 31 and can likewise build up a pressure there which corresponds to the pressure in the high-pressure fuel reservoir. This results in the fact that the control valve member 23 remains in the position shown in which the first sealing face 32 is resting against the first valve seat 36 and consequently, a connection is prevented between the annular chamber 39 and the annular chamber 45. Therefore in addition, high-pressure fuel cannot travel from the pressure line 40 into the pressure chamber 9 via the pressure conduit 12 and bring the fuel injection valve member 2 into the open position. In this instance, no injection takes place, the injection valve member 2 is kept in the closed position through the action of the restoring force in the form of the clamped compression spring 17. In order to trigger a fuel injection, the piezoelectric drive mechanism 73 is now excited and the closing body 56 lifts up from the second valve seat 64 so that the working chamber 31 is relieved. This results in the fact that the control valve member 23, through the action of a restoring force, which can for example be a pressure shoulder on the closing member that is loaded by the fuel pressure or can be a spring that is not shown in detail, is moved in such a way that it lifts with its first sealing face 32 up from the first valve seat 36 and produces a connection between the annular chamber 39 and the annular chamber 45 by way of the diameter narrowing 34 and thus, the fuel can travel from the high-pressure fuel reservoir into the pressure chamber 9 by way of the pressure conduit 12. As a result, the fuel injection valve member 2 is lifted up from its valve seat 7 and a fuel injection takes place. In order to interrupt this fuel injection or to end it, the closing body 56 must be brought to rest against one of the seats 60 or 64. At this moment, the original high pressure builds up again in the working chamber 31 through the inflow of high-pressure fuel via the conduit 41 so that the control valve member 23 is moved back to the first valve seat 36 and consequently the inflow of high fuel pressure is prevented. This brings about the end of injection. In this position of the control valve member 23, the annular chamber 45 communicates with the chamber 18 by way of the flattend region 47 so that the pressure in the pressure chamber 9 can be rapidly relieved. This encourages a rapid closing of the injection valve.

The closing body 56 can be moved in various ways by means of the piezoelectric drive mechanism. In the first mode, the piezoelectric drive mechanism 73 can be excited and this results in a movement of the closing body 56 away from the first valve seat 64, with a subsequent relief of the working chamber 31 when the relief line 50, 66 is open, and then a re-contacting of the closing body 56 with its second sealing face 61 against the second valve seat 62 and a re-closing of the relief conduit. Therefore with this process, the working chamber 31 is momentarily relieved and then the pressure in the working chamber 31 is built back up to the original value. This results in the fact that the control valve member 23 executes a short movement while likewise momentarily producing the connection between the pressure line 40 and the pressure conduit 12, which triggers a short injection.

After this, the injection valve member 2 is immediately closed again because the connection between the pressure line 40 and the pressure conduit 12 is also prevented by the re-closing of the control valve member 23. This kind of a short injection is particularly advantageous for the production of a pre-injection in diesel internal combustion engines. For a subsequent main injection, the closing body 56 is brought into a middle position between the two valve seats 64 and 60 so that the working chamber 31 remains relieved longer and correspondingly, the fuel injection valve member 2 is also lifted up from its valve seat for a longer time in accordance with an associated main fuel injection quantity.

For a preferable pre-injection with a subsequent main injection, the piezoelectric drive mechanism 73 is consequently excited so that it first moves the closing body 56 away from the second valve seat 64 to the first valve seat 60, which results in a pre-injection. Then the closing body 56 is brought back into a middle position and, to end the main injection, is finally brought back against the second valve seat 64. Consequently, for both a pre-injection and a main injection, the closing body executes only a single back and forth motion with a correspondingly low excitation energy for its drive, with a high switching speed. In particular, due to this construction, a very short injection without mass movement reversal energy can be controlled with the aid of a small control valve.

The foregoing relates to a preferred exemplary embodiment of the invention, it being understood that other variants and embodiments thereof are possible within the spirit and scope of the invention, the latter being defined by the appended claims.

I claim:

1. A fuel injection device for internal combustion engines, comprising a high-pressure fuel source (13), which is connected via a pressure line (40) to a pressure chamber (9) of an injection valve (1), which has an injection valve member (2) which, via high-pressure fuel supplied to the pressure chamber (9) acting on a pressure shoulder (16) of the injection valve member counter to a restoring force (17), opens injection openings (8) for the fuel injection and closes upon relief of the pressure chamber (9) to a relief conduit (19), and the connection of the pressure line (40) to the pressure chamber (9) and the connection of the pressure chamber (9) to the relief conduit (19) is controlled by an electrically controlled control valve (24) that is embodied as a 3/2-way valve and has a control valve member (23), further comprising the control valve member (23) has a piston part (28) that can move in a guide bore (27) and with its end face (29), defines a working chamber (31) connected via an inflow cross section (42) to a pressure source of a high pressure level and is relieved by way of a relief line (50), in order to reduce pressure therein and to actuate the control valve member (23) by means of an electrically controlled pre-control valve (55), and a spring-loaded valve member (54) of the pre-control valve is driven by a piezoelectric drive mechanism (73) and has a closing body (56) provided with first and second sealing faces (61, 62) respectively disposed on each of its opposing ends in the movement direction, which sealing faces cooperate with two valve seats (60, 64), wherein a first valve seat (60) defines an entry of the relief line (50) into a valve chamber (53) that contains the closing body (56) and a second of the valve seats (64) defines a re-emergence of the relief line (50) from the valve chamber (53), further wherein a distance of separation of the valve seats (60, 64) from each other is chosen such that in a first time period defined by an achievable adjusting speed of the valve member (54) of the pre-control valve over the path from the lifting of the closing body (56) up from one of the valve seats (60, 64) until the contacting of the closing member (56) against the other valve seat (60, 64), a relief of the working chamber (31) takes place, which relief leads to an injection event determined by said time period through the actuation of the injection valve member (2), and further wherein in order to control a large main injection quantity, the closing body (56) can be brought into an intermediate position between the two valve seats (60, 64) allowing a main injection quantity to reach injection for the duration of a second time period that this intermediate position is maintained.

2. The fuel injection device according to claim 1, in which the sealing faces (61, 62) are embodied as conical.

3. The fuel injection device according to claim 2, in which the closing body (56) is disposed at the end of a tappet (57) whose other end is coupled to the piezoelectric drive mechanism (73) by way of a hydraulic chamber (71).

4. The fuel injection device according to claim 3, in which a portion of the tappet (57) adjoining a sealing face (62) has a reduced diameter and, together with a guide bore (58) that guides the tappet (57) and leads from the valve seat (64), defines an annular chamber (65) which is a part of the relief conduit (50) and an exit conduit is disposed in a wall of the guide bore (58) encompassing the annular chamber (65) to continue the relief line (50) toward the relief chamber.

5. The fuel injection device according to claim 4, in which a first throttle (51) is formed in the relief line (50), preferably upstream of the valve chamber (53).

6. The fuel injection device according to claim 5, in which the inflow cross section to the working chamber (31) is embodied as a second throttle (42) in a conduit (41) that is routed through the piston part (28) and feeds at the end face (29) of the piston, which conduit leads from an annular chamber (39) that encompasses the control valve member (23) and communicates with the pressure source (13) having the high pressure level.

* * * * *